US008608381B2

(12) United States Patent
Zoss

(10) Patent No.: US 8,608,381 B2
(45) Date of Patent: Dec. 17, 2013

(54) EASY POUR BAG

(75) Inventor: Robert A. Zoss, Plymouth, MN (US)

(73) Assignee: General Mills, Inc., Minneapolis, MN (US)

( * ) Notice: Subject to any disclaimer, the term of this patent is extended or adjusted under 35 U.S.C. 154(b) by 998 days.

(21) Appl. No.: 11/381,547

(22) Filed: May 4, 2006

(65) Prior Publication Data

US 2006/0285781 A1 Dec. 21, 2006

Related U.S. Application Data

(60) Provisional application No. 60/684,769, filed on May 26, 2005.

(51) Int. Cl.
*B65D 30/00* (2006.01)

(52) U.S. Cl.
USPC ..... 383/107; 383/906

(58) Field of Classification Search
USPC ..... 383/107, 906, 907; 426/106; 53/284.7
See application file for complete search history.

(56) References Cited

U.S. PATENT DOCUMENTS

| | | | | |
|---|---|---|---|---|
| 2,214,944 | A * | 9/1940 | Vogt | 229/117.32 |
| 3,314,591 | A * | 4/1967 | Cheeley | 383/94 |
| 3,387,701 | A * | 6/1968 | Schneider et. al. | 206/527 |
| 5,547,284 | A * | 8/1996 | Imer | 383/104 |
| D384,863 | S | 10/1997 | Danemayer | |
| D390,753 | S | 2/1998 | Danemayer | |
| 5,826,754 | A | 10/1998 | Ishaya et al. | |
| 6,206,571 | B1 | 3/2001 | Olin | |
| 6,318,626 | B1 * | 11/2001 | St. Pierre et al. | 229/117.3 |
| 6,352,365 | B1 * | 3/2002 | Healy et al. | 383/209 |
| 6,592,917 | B2 * | 7/2003 | Yoon | 426/110 |
| 6,857,779 | B2 | 2/2005 | Olin | |
| 7,011,448 | B2 | 3/2006 | Olin | |
| 7,025,504 | B2 | 4/2006 | Olin | |
| 2001/0010737 | A1 * | 8/2001 | Olin | 383/204 |
| 2004/0136619 | A1 * | 7/2004 | Spork et al. | 383/88 |
| 2005/0157959 | A1 * | 7/2005 | Johnson | 383/61.2 |
| 2005/0238766 | A1 * | 10/2005 | Henderson et al. | 426/106 |
| 2006/0291755 | A1 | 12/2006 | Olin | |

* cited by examiner

*Primary Examiner* — Nathan J Newhouse
*Assistant Examiner* — Peter Helvey
(74) *Attorney, Agent, or Firm* — John L. Crimmins; Timothy A. Czaja

(57) ABSTRACT

Vertical fill and form bags fabricated from flexible packaging film are provided with at least one transverse seal at an oblique angle. Upon opening, the oblique angled seal provides a natural use easy pour dispensing feature. The bag is intuitively and ergonomically easy to use to facilitate controlled pouring without spilling. The bag are especially useful for bulk particulate contents especially consumer food products such as ready-to-eat cereals for use in food service venues such as universities and hospitals. Apparatus and method of preparation for the productions of the easy pour bulk bags are described including using transverse sealers at least one of which is oriented at an angle such as to impart the oblique angled transverse seal.

17 Claims, 7 Drawing Sheets

EASY POUR BAG

CROSS-REFERENCES TO RELATED APPLICATIONS

This application claims the benefit of priority under 35 U.S.C. 119(e)(1) of a provisional patent application, Ser. No. 60/684,769, filed May 26, 2005, which is incorporated herein by reference in its entity.

BACKGROUND OF THE INVENTION

The present invention relates to the art of packaging, to packaged products and to their methods of preparation. More particularly, the present invention relates to an easy pour bag fabricated from a flexible packaging film especially for food products.

A wide variety of products are packaged in bags or pouches fabricated from flexible packaging film especially vertical form fill and seal bags. These packaged bag products are often for bulk quantities of contained materials, especially dry materials. For example, bulk quantities can be for household use such as for water softener salt, cement, garden or landscaping materials or chemicals, (e.g., fertilizer, sand, mulch), pet food, etc. Bulk quantities can be packaged for commercial or industrial applications. Among commercial applications, the present invention finds particular suitability for use in food service applications. For example, a wide variety of food products are packaged in bulk for food service venues such as cafeterias (especially college or university or military facilities, hospitals or nursing homes, etc.), hotels, and restaurants.

In particular, ready-to-eat or breakfast cereals are typically packaged in bulk for use at food service venues. Once opened, the contents can be used to fill particular food dispensers (See, for example, US Des 384,863 "Bulk Dispenser For Comestibles" issued Oct. 14, 1997 to Danemayer or US Des. 390,753 "Bulk Dispenser For Comestibles" issued Feb. 17, 1998 to Danemayer, or U.S. Pat. No. 5,826,754 "Bulk Dispenser For Comestibles" issued Oct. 27, 1998).

Conventional pouches or bags include closure transverse seals or closure generally at right angles to the bag body. While useful, opening and dispensing the contents from such bulk opened bag can be awkward resulting in spillage of the food product. Not only does such spillage result in lost product but also spilled product requires clean-up. With a conventional bag, when the bag of, for example, cereal is poured into a bulk dispenser the intuitive way for the user to hold the bag is by the main body holding both the bag material and the cereal. This is awkward and adds to the mess that is generated when pouring. When the top seal is changed from the conventional 90° or right angle (relative to the main bag body) to an oblique angle as in the present invention, it becomes more natural for the user to grab the bag by the side. The bag forms a natural handle increasing the ease of pouring and reducing the probability of spilling cereal. This natural handle is a benefit resulting from the top seal being placed at an oblique angle. Also, while such problems of conventional bags and the advantages of the present easy pour bag are applicable to the filling of Ready-To-Eat cereal dispensers, such problems of conventional bags and advantages of the present bags are even more applicable when the bags are used to add contents to individual cereal bowls in large numbers such as for school cafeterias.

Thus, it would be desirable for such bulk pouches to include a feature that facilitates dispensing therefrom. Moreover, it would be desirable for such an easy pour feature be intuitively easy to use without need for instruction.

BRIEF SUMMARY OF THE INVENTION

The present invention addresses these and other concerns in the structure of bag packages. In one article aspect, the present invention resides in containers or packages such as bags or pouches 10 fabricated from a flexible packaging film having an easy pour feature. The bag 10 has a longitudinally extending body 12 having an upper and a lower openings. The bag includes a first or lower transverse flexible closure 20 (e.g., seam, or seal) for closing the lower opening and an opposed upper flexible transverse closure 22 for closing the upper opening. The bag 10 is further characterized in that at least one transverse closure is at an oblique angle relative to the longitudinally extending body.

The present invention provides an apparatus 100 useful in the fabrication of containers 10 of the present invention. Apparatus 100 includes a means for providing a continuous ribbon of flexible film packaging material 36; a means 30 for forming the film material into a container having at least one transverse seal at an oblique angle, and a means for filling the container with contents 46.

The present invention provides methods of producing the present package including forming at least a first transverse closure to a bag having a body with at least one open end, said transverse closure being at an oblique angle to the body. Additional objects, features and advantages of the method and apparatus for loading bags in accordance with the present invention will become more readily apparent from the following detailed description of the preferred embodiment thereof when taken in conjunction with the drawings wherein like reference numerals refer to corresponding parts in the several views.

BRIEF DESCRIPTION OF THE DRAWINGS

The illustrative embodiment may best be described by reference to the accompanying drawings where.

Figure 1:
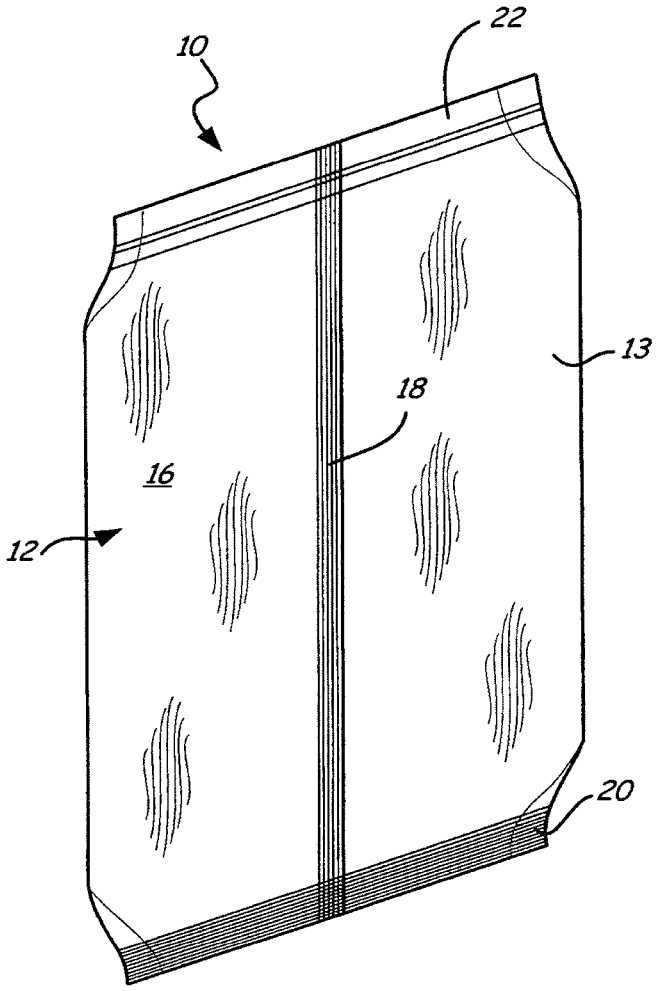
FIG. 1 is a rear plan view of a flexible film bag of the present invention.

All Figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various Figures of the drawings, the same numerals designate the same or similar parts. Furthermore, when the terms "top", "bottom", "first", "second", "side", "end", "edge", "front", "back", "inner", "outer", "upper", "lower", and similar terms are used herein, it should be understood that these terms have reference only to the structure shown in the drawings as it would appear to a person viewing the drawings and are utilized only to facilitate describing the preferred embodiment.

DETAILED DESCRIPTION OF THE INVENTION

The present invention provides to easy pour bags characterized by at least one transverse closure being at an oblique angle; to apparatus for forming such bags; and, to methods of their preparation.

Throughout the specification and claims, percentages are by weight and temperatures in degrees Centigrade unless otherwise indicated. Each of the referenced patents and patent applications are incorporated herein by reference.

The present invention is now illustrated in greater detail by way of the following detailed description, but it should be understood that the present invention is not to be construed as being limited thereto.

Referring now to the drawings and especially to FIG. 1, an easy pour container according to the preferred teachings of the present invention is shown in the drawings and generally designated 10. In the preferred form, the container 10 is a flexible or pliable bag or pouch such as fabricated from a flexible packaging film 13 especially for food products. While throughout the specification and claims particular attention is paid to larger bags such as for food service, both smaller containers or pouches as well as other embodiments are contemplated. Bag 10 includes a longitudinally extending body 12 having a first or lower opening sealed by a first or lower transverse closure or seal 20 and opposed second or upper opening sealed by a second or upper transverse closure or seal 22.

The body 12 includes opposed major surface such as a first or front major surface 14 and a second or rear major surface 16. The body 12 can be fabricated by any flexible packaging film material 13. Single ply flexible packaging film materials such as polyethylene or polypropylene or various blends are popular for materials that are not sensitive and do not require special protection, e.g., water softener salt or sand. More sophisticated food packaging flexible films are well known such as various laminated or multi-layered films that provide particular combinations of desired packaging features. For example, for food packages for Ready-to-Eat cereal products ("RTE" cereals"), composite or laminated packaging flexible film materials are well known that are clear thus revealing their contents yet nonetheless provide high levels of moisture barrier properties. In other variations, the packaging film material 13 can be opaque such having a foil layer for improved or superior moisture barrier properties. Various combinations of transparent and opaque packaging films are known and contemplated for use herein.

Figure 7:
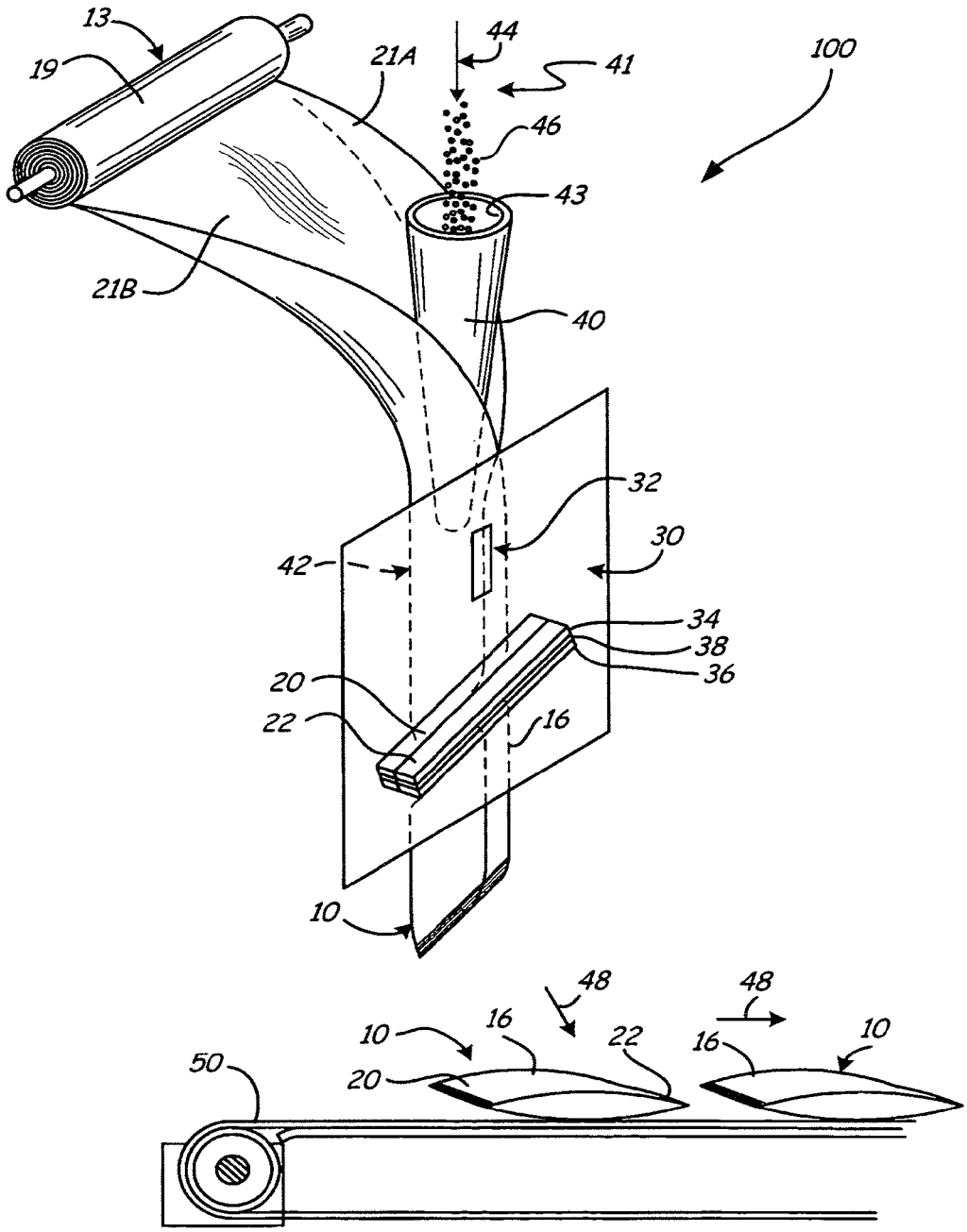
FIG. 7 is a combined perspective and front elevation view of illustrative apparatus for fabricating and filling flexible pouches in accordance with the present invention.

In the preferred form, the body 12 can be in the form of a tube. In certain variations, the tube is formed of flexible film material 13 already formed into a tube and having a single continuous curved surface such as forming a cylinder. Referring now briefly to FIG. 7, more commonly, the flexible film material is provided in the form of a continuous roll or ribbon 19 having opposed free side edges 21A and 21B or margins. The film material 13 is advanced around a forming horn or funnel 40 (as described in more detail below) and is formed into the tube by sealing the opposed free edges 21A and 21B together to form a longitudinally extending seal such as the rear lap or fin seal 18 depicted in FIG. 1. Typically such a longitudinal seal 18 is positioned on the major face surface that is used as the rear major face panel such that the seal 18 interferes less with packaging graphics.

In other variations (not shown), two ribbons or rolls of packaging material can be provided with opposed side seals to form the package body and without a rear longitudinal seal. In still other variations (not shown), a tube is formed by sealing the two free edges 21A and 21B together in a single fin seal to provide a body having only a single longitudinal seal (typically a side seal) to provide a tube having one curvilinear side edge and an opposed side seal but no front or rear seals.

Figure 2:
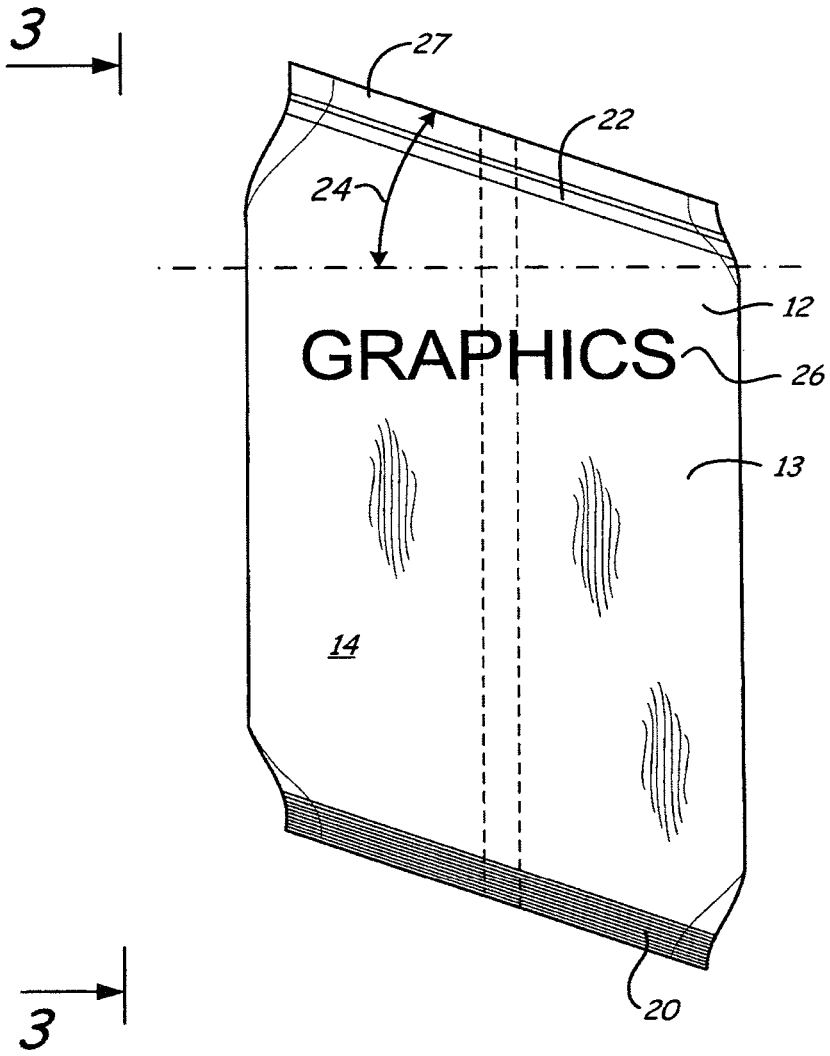
FIG. 2 is a front plan view of a bag of the present invention.

Referring again to FIG. 1, the present package includes a first or lower transverse flexible end closure 20 (e.g., seam, or seal) for closing the lower bag opening and an opposed upper flexible transverse end closure 22 for closing the bag upper opening. The bag is further characterized in that at least one transverse end closure is at an oblique angle relative 24 to the longitudinally extending body. In the preferred form, the at least one oblique angle transverse end closure is the upper closure. In more preferred forms, both the upper and lower transverse closures are at an oblique angle. In the most preferred embodiment, both the upper and lower transverse seal closures are at an acute oblique angle of the same value such that the upper and lower transverse seals are parallel as seen in FIGS. 1 and 2. This allows for one set of sealing jaws to perform forming of both the lower and upper seals 20 and 22.

Figure 5:
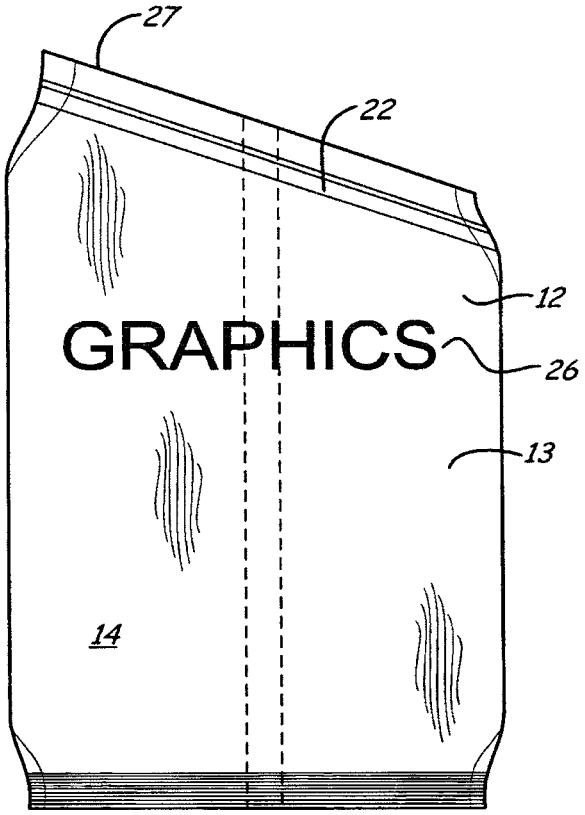
FIG. 5 is a front plan view of a flexible film bag of the present invention having a single obliquely angled transverse seal.

In other variations such as seen in FIG. 5, the bag 10 includes at least one transverse closure or seal at an acute oblique angle such as the upper transverse closure depicted. In the embodiment depicted in FIG. 5, the lower transverse closure, however, is at a conventional right angle such as the top seal 22 depicted. Thus, the embodiment depicted in FIG. 5 has only a single transverse closure at an oblique angle. While useful, the embodiment depicted is not as easily fabricated and requires multiple sealing jaws for fabrication; namely one at right angles and a second set oriented at an acute angle.

Figure 6:
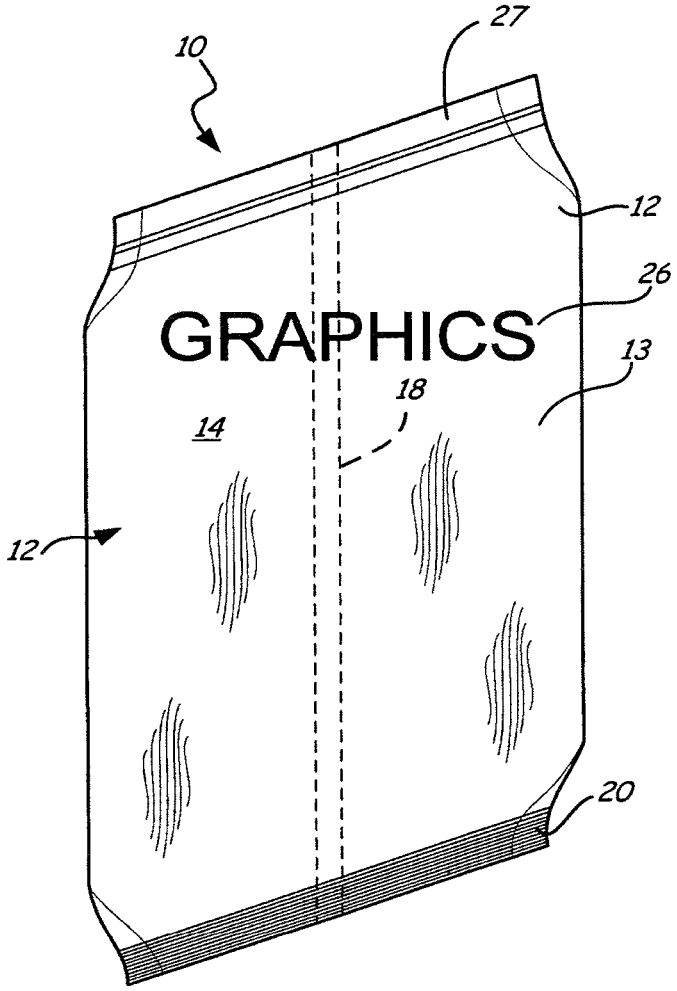
FIG. 6 is a front plan view of a flexible film bag of the present invention having a pair of obtuse oblique angled transverse upper and lower seals.

FIG. 2 depicts that in the preferred form the oblique angled closure is at an acute angle 24 ranging from about 10° to about 45°, preferably about 15° to 30°. At an acute angle of less than 10° the spout formed upon opening of the bag for use forms a pour spout that provides less functionality or improvement over the conventional rectangular bag form. At a transverse seal angle of greater than 45°, the bags 10 become increasingly difficult to pack in a rectangular cardboard case. Comparable obtuse oblique angles can be used (see FIG. 6) and can range from about 100° to 135° except that the pour spout formed is to the opposite bag side.

The bag 10 can include graphics 26 preferably on the front major surface or panel 14. In preferred form, the graphics are positioned proximate upper flexible transverse end closure 22 so as to naturally indicate or suggest to the user which end is the upper end. (By proximate is meant less than ⅓height of the bag or the distance between the upper and lower transverse seals.) FIGS. 2, 4, 4A, 5 and 6 further illustrates that the bag 10 can include a pair of end opening flaps 27 proximate upper flexible transverse end closure. Conveniently, such flaps 27 can extend for about 10-20 mm in length beyond the closure 20. Such flaps 27 facilitate controlled opening of the end product by pulling apart seal closure 22. In other variations (not shown), the container 10 can be provided with other easy open features such as cuts, nicks, tear-open strings and the like. In other variations, the film material can be selected to either facilitate or resist tearing depending upon particular needs of end use applications. In still other variations, the bags can be provided with reclosure features such as zip-lock bands.

Figure 3:
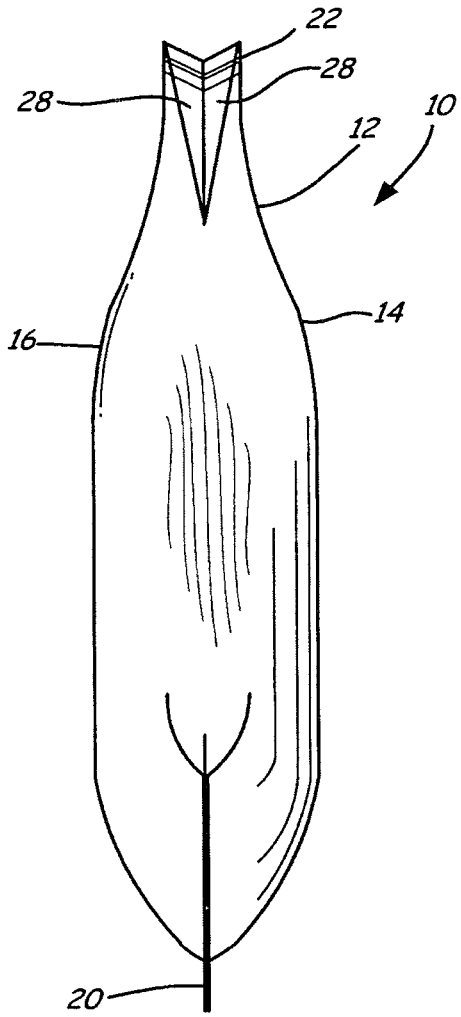
FIG. 3 is side view taken in the direction of line 3-3 of FIG. 2.
Figure 4:
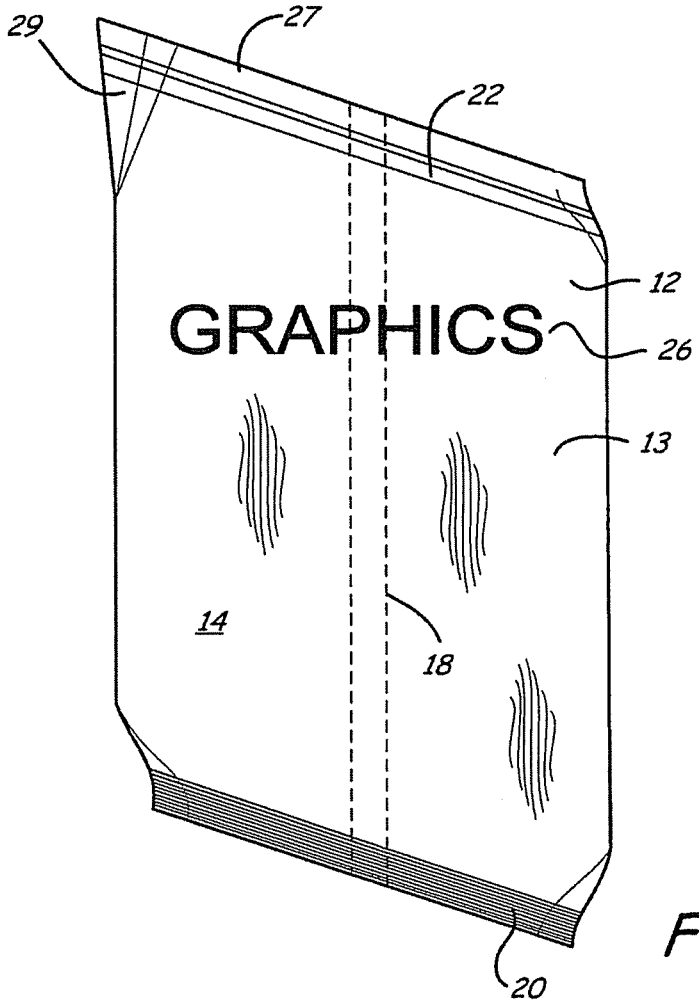
FIG. 4 is an plan view of an easy pour spout feature of an opened bag a flexible film package of the present invention.
Figure 4A:
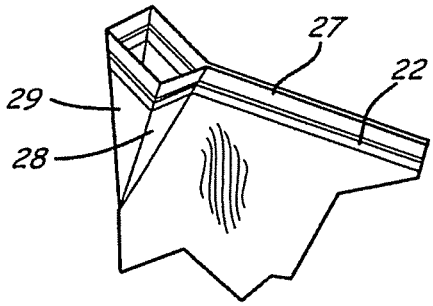
FIG. 4A is an enlarged partial view of the easy pour spout feature of an opened bag.

Referring now briefly to FIG. 3, it can be seen that the upper transverse seal closure or seam 22 can include an upper pair of left side gussets 28 as well as an upper pair of right side gussets (not shown). Likewise the lower transverse seal 20 can include a right and left pairs of side gussets (not shown). The transverse seal side gussets generally facilitate bag formation. However, as best seen in FIGS. 4 and 4A, the upper pair of left side gussets 28 can also serve to form an easy pour spout feature 29 upon opening of the upper transverse closure 22.

In a preferred embodiment, the package 10 is configured for food service to hold about 0.75-1.5 kg of RTE cereal. Conveniently, the package has a fill volume of about 3-5 liters.

Referring once again to FIG. 7 there is shown an apparatus useful in the fabrication of containers 10 of the present invention generally designated by reference numeral 100. Apparatus 100 can include a means for providing a continuous ribbon of flexible film packaging material 36; a means 30 for forming the film material into a container having at least one transverse seal at an oblique angle; and, a means for filling the container with contents 46. The forming mechanism 30 has been denoted generally in block form.

The packaging film supply means 36 can supply the film 13 in the form of a tube. In the preferred embodiment depicted in FIG. 5, however, the film supply means 36 can supply the flexible packaging film material 13 in the form of a continuous ribbon 19 having opposed free side edges 21A and 21B.

In the preferred embodiment wherein the film 13 is supplied in the form of a continuous ribbon and not in the form of a tube, then the means for forming 30 can include a means for forming the continuous ribbon 19 into a tube 42 including a hollow forming horn, tube or funnel 40. As can be understood from FIG. 7, the flexible film roll stock 13 as it is drawn from its rolled condition is urged or formed on forming horn or funnel 40 into a tube or trough-like configuration 42. The marginal portions or free ends 21A and 21B of the stock 12 are urged into engagement and are heated by and the container forming means 30 can additionally include, a first vertically oriented sealer 32 to form a length-wise or longitudinally extending sealing together or seal 18 of the tube 42 that becomes the container or pouch 10. The film 13 can contain repetitive graphics and other display information (e.g., ingredients listings, nutritional information, usage instructions, used container recycling information, production codes, etc.) in a repetitive pattern including station indexing indicia.

In one specific illustrative embodiment for the production of bulk bags having an internal volume of about 3-5 liters, the film stock 13 can have a width of about 50-65 cm.

Container forming means 30 can additionally include an upper horizontal or transverse sealer 34 that seals the bottom of the tube 42 being formed by the forming means 30 to provide a first lower transverse seal or closure 20 having an oblique angle. To provide a lower transverse seal having an oblique angle, the upper sealer 34 can be positioned at the desired oblique angle relative to vertical.

Container forming means 30 can additionally include a second lower horizontal or transverse sealer 36 to provide an upper transverse seal or closure 22 having an oblique angle seals the upper end of a preceding envelope 42 that results in a completed pouch or bag 10. To provide in the preferred form an upper transverse seal having an oblique angle, the second or lower sealer 36 can be positioned at the desired oblique angle relative to vertical. In other variations, sealers 34 and 36 can be oriented at an obtuse angle relative to vertical.

In the preferred form, sealer means 32, 34 and 36 can be a heat sealer and can comprise a pair heat seal jaws to provide a heat seal type seal and the film 13 can be a heat sealable type packaging film. In another embodiment, the sealers 32, 34 and 36 can be a pressure sealer comprising a pair of pressure jaws and used to impart a pressure seal and film material 13 can be a pressure sealable film packaging material rollstock.

Forming means 30 can additionally include a cutter means 38 for severing the lower container 10 that has already been completed from the yet to be completed envelope configuration 42. Conveniently as depicted in FIG.7, cutter means 38 (e.g., a knife) can be positioned intermediate sealers 34 and 36. In the preferred embodiment of parallel transverse acute angled seals, a single cutter can be employed that is likewise oriented at an angle to provide a cut parallel to the transverse seals.

The seal jaws 34 and 36 are operated at timed intervals associated with the roll stock supply advance speed to provide bag of desired length and thus internal storage volume. In a preferred illustrative example for the provision of bags having an internal volume of about 3-5 liters, the bag length between transverse seals can extend for a length or height of about 35-60 cm, preferably about 40-50 cm.

Attention is now directed to contents supply means 41 that delivers a measured quantity or supply of contents 46 from an upper hopper (not shown) into the envelope or trough 42 that results in the completed pouch 10. The contents can be either liquid, or, in the preferred form, solid particulates especially free flowing particulates. The particulates can be individual pieces of food such as RTE cereal, pet rations or livestock feed rations, popcorn (whether popped or kernel popcorn), fried snacks (e.g., potato chips, corn chips), peanuts, candies, gelled shaped fruit pieces, etc. The contents can be non food application particulates such as water softener salt pellets, landscaping materials such as pebbles or mulch, fertilizer pellets, pool chemicals (e.g., chlorination pellets). In other minor variations, the particulates can be smaller sized such as foods including flours, baking mixes, bulk ingredients, e.g., sugar, milk solids, salt, starch, chocolate powder, soy flour. Non food smaller particulates can include cement, sand, mortar mix or joint compound or any common dry material.

Contents supply means 41 can be seen to include the inner passageway 43 of funnel 40. The flow of the contents 46 is downwardly such as by gravity feed as indicated by a direction arrow 44. In certain variations, the contents supply means 41 can additionally include dust control elements such as a vacuum (not shown) or headspace gas supply (for controlled atmosphere packaging, e.g., nitrogen, $CO_2$,). In other variations, more than one type of contents can be supplied to the bag or container 10 to provide blends of contents. In still other variations, the vacuum or air removal can be practiced to provide a bag 10 having a reduced air or even vacuum packaging.

After sealing by the sealers 32, 34 and 36, the abovementioned severance by the cutter 38 enables the completed filled bag 10 to fall gravitationally onto a take away conveyor 50 there beneath, the directional movement of the completed bag 10 for subsequent placement in cases or cartons being indicated by the arrows 48.

Of course, while the present invention finds particular suitability for use in connection with vertical form and fill bag, the present invention can also be used in horizontal form and fill flexible bag packaging equipment.

Now that the basic construction of apparatus 100 according to the preferred teachings of the present invention have been set forth, a method of operation of apparatus 10 for the production of bags or containers 10 can be explained and some of the advantages of apparatus 100 can be highlighted.

In its method of preparation aspect, the present invention resides in methods of forming bag 10 having at least on transverse seal at an oblique angle. The methods can comprise a first step of providing a continuous supply of flexible film packaging material in the form of a continuous roll or ribbon of film rollstock as described in detail above.

As the film stock is drawn or unwound from the roll, the present methods can include the step of forming or folding the ribbon of film into an envelope or trough-like configuration by a forming mechanism to form a partially formed bag having an upper opening. This step can include the bringing together in confronting relationship the marginal or opposed free edges of the ribbon or strip of film material. The step can further include the sub-step of sealing the marginal portions thereof to provide a longitudinally extending seal. In preferred form, the free edges are brought together so as to form a lap seal.

The forming step can further include a sub-step of forming a lower transverse seal of the bottom of the envelope or trough-like configuration just formed. The forming step can further include a sub-step of forming a second upper transverse sealing therebelow that seals and closes the top or upper opening of the preceding or previously formed bag, thereby completing the closing of the preceding bag. In preferred form, each transverse seal is at an oblique angle (relative to vertical or longitudinally extending fin or lap seal). In more preferred form, each oblique angled transverse seal is at an equal angle such that the transverse seals are parallel. Also, the method is preferably practiced (such as by placement of the first and second means relative placement in respect of each other) to provide the upper transverse seal with about 10-20 mm of extra film material such as to provide a end opening flaps proximate the upper transverse seal.

During the forming step, the methods can include a step of adding or supplying a quantity of contents (and whatever other ingredients are to be included) through the funnel or other channel means into the folded configuration as the envelope or trough is longitudinally sealed along marginal portions thereof.

The present forming step can additionally include a sub-step of severing or cutting the preceding pouch, which has been filled and sealed, between the two transverse seals. The bags 10 so prepared are each characterized by at least one transverse seal being at an oblique angle. The bags 10 are permitted to fall freely onto a takeaway conveyor 50 there beneath. Thus, the bags are successively severed or cut from the laminated stock to provide a series of filled bags which are deposited on a conveyor.

Upon opening, the oblique angled seal provides a natural use easy pour dispensing feature. The bag is intuitively and ergonomically easy to use to facilitate controlled pouring without spilling. The bag are especially useful for bulk particulate contents especially consumer food products such as ready-to-eat cereals for use in food service venues such as universities and hospitals. For, example, containers of the present invention can be used to hold quantities of Ready-To-Eat cereals that are then used to fill cereal dispensers. The containers also find particular suitability for use in cafeterias for elementary schools where the bags' cereal contents are used to fill manually a large number of bowls with small quantities of ready-to-eat cereals for children. In such use environments, minimization of loss or spillage is a special concern.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A bag article, comprising:

a longitudinally extending body fabricated from a flexible packaging film, the body defining an upper opening and a lower opening;

a lower transverse closure closing the lower opening; and an opposed upper transverse closure closing the upper opening;

wherein the lower transverse closure and the upper transverse closure are each:

entirely linear in a single direction in extension across the corresponding opening, arranged at an oblique angle relative to the longitudinally extending body, and parallel with respect to one another;

and further wherein the upper transverse closure includes:

a continuous, uninterrupted, non-reclosable seal extending across an entirety of the upper opening, and a pair of flaps above the continuous seal opposite the lower transverse closure, the flaps being free from one another.

2. The bag article of claim 1 wherein the upper transverse closure is at an acute oblique angle.

3. The bag article of claim 2 wherein the acute oblique angle ranges from about 10° to 45°.

4. The bag article of claim 1 wherein the pair of flaps ranging from about 10-20 mm in length.

5. The bag article of claim 4 the acute oblique angle ranges from about 20°-30 °.

6. The bag article of claim 3 wherein each transverse closure is a heat seal.

7. The bag article of claim 1 wherein the body includes a longitudinally extending lap or fin seal.

8. The article of claim 1 fabricated from a flexible film providing moisture barrier properties.

9. The article of claim 8 wherein the body includes a front major surface and an opposed rear major surface and wherein the front major surface includes graphics positioned proximately below the upper transverse closure.

10. The bag article of claim 1, further comprising particulate material contained within the body.

11. The bag article of claim 10, wherein the particulate material is a dried food product.

12. The bag article of claim 11, wherein the particulate material is a Ready-to-Eat cereal.

13. The bag article of claim 1, further comprising a pair of gussets located along one of the upper and lower transverse closures, wherein the pair of gussets are configured to form a pour spout feature.

14. The bag article of claim 13, wherein the pair of gussets is a first pair of gussets on a first side of the upper transverse closure, the bag article further comprising a second pair of gussets on an opposing, second side of the upper transverse closure.

15. The bag article of claim 13, wherein the pair of gussets are defined at the upper transverse closure and are configured to transition from a folded state to an unfolded state in which the pour spout feature is formed, and further wherein in the unfolded state, a leading edge of the pair of gussets is parallel with the linear extension of the upper transverse closure.

16. The bag article of claim 1, wherein the body defines opposing, terminal side longitudinal edges and the continuous seal of the upper transverse closure extends between and interconnects the opposing longitudinal edges, and further wherein a linear length of an entirety of the continuous seal in complete extension between the opposing longitudinal edges is less than a maximum width of the longitudinally extending body at any location between the upper and lower transverse closures in a direction parallel with the upper transverse closure.

17. The bag article of claim 1, further comprising a longitudinal side seal formed along a rear major face of the longitudinally extending body and continuously extending between, and intersecting, the upper and lower transverse closures.

* * * * *